United States Patent [19]

Leifeld

[11] Patent Number: 4,805,267

[45] Date of Patent: Feb. 21, 1989

[54] DEVICE FOR SEPARATING IMPURITIES FROM FIBER MATERIAL DURING ITS TREATMENT BY A CARD

[75] Inventor: Ferdinand Leifeld, Kempen, Fed. Rep. of Germany

[73] Assignee: Trützschler GmbH & Co. KG, Mönchengladbach, Fed. Rep. of Germany

[21] Appl. No.: 135,524

[22] Filed: Dec. 17, 1987

[30] Foreign Application Priority Data

Dec. 24, 1986 [DE] Fed. Rep. of Germany ..... 3644529

[51] Int. Cl.[4] ..... D01G 9/08; D01G 15/00

[52] U.S. Cl. ..... 19/105; 19/107

[58] Field of Search ..... 19/105, 107

[56] References Cited

U.S. PATENT DOCUMENTS

| | | | |
|---|---|---|---|
| 3,120,030 | 2/1964 | Reiterer | 19/105 |
| 3,792,509 | 2/1974 | Morikawa et al. | 19/105 |
| 4,064,598 | 12/1977 | Katoh et al. | 19/107 X |
| 4,379,357 | 4/1983 | Beneke et al. | 19/105 |

FOREIGN PATENT DOCUMENTS

| | | |
|---|---|---|
| 2743187 | 3/1978 | Fed. Rep. of Germany . |
| 2931699 | 5/1981 | Fed. Rep. of Germany . |
| 3034036 | 4/1982 | Fed. Rep. of Germany . |
| 0974471 | 11/1964 | United Kingdom . |

*Primary Examiner*—Louis K. Rimrodt
*Attorney, Agent, or Firm*—Spencer & Frank

[57] ABSTRACT

A carding machine includes a main cylinder having a direction of rotation, a licker-in cooperating with the main cylinder, travelling flats cooperating with the main cylinder, and a frontal end roller supporting the travelling flats. The end roller is situated above the licker-in at a distance therefrom as viewed circumferentially along the main cylinder. The distance has a mid-zone and two off-center zones flanking the mid-zone and adjoining the licker-in and the end roller, respectively. There is further provided a device for separating impurities from fiber material undergoing treatment by the main cylinder. The device has a knife blade supported at a small radial distance from the main cylinder and a plate supported at a small radial distance from the main cylinder and defining a gap with the knife blade. The gap is in the work zone of a suction chamber. The separating device is situated in one of the off-center zones.

5 Claims, 5 Drawing Sheets

DEVICE FOR SEPARATING IMPURITIES FROM FIBER MATERIAL DURING ITS TREATMENT BY A CARD

BACKGROUND OF THE INVENTION

This invention relates to a device for separating impurities such as trash, shell fragments and the like from fiber material during its treatment by a carding machine or a roller card unit. The device is situated above the licker-in and has a knife blade which is oriented against the direction of rotation of the main carding cylinder and is at a small radial distance therefrom. A plate is held at a small radial distance from the main cylinder and at a small circumferential distance from the knife blade upstream thereof as viewed in the direction of rotation of the carding cylinder. The separating device further has a suction arrangement which includes a suction chamber extending over the clearance defined between the plate and the knife blade.

According to a known device, the knife blade is situated approximately in the middle between the licker-in and the frontal deflecting roller for the travelling flats. At that location, the cover of the cylinder has an opening. The air pressure generated by the rotation of the carding cylinder generates a strong air stream escaping through the opening. Such strong air stream is disadvantageous in that useful fibers are entrained thereby in large quantities.

SUMMARY OF THE INVENTION

It is an object of the invention to provide an improved device of the above-outlined type from which the above-noted disadvantages are eliminated and with which particularly the quality of separation of impurities such as trash, shell fragments and the like without loss of useful fiber is improved.

This object and others to become apparent as the specification progresses, are accomplished by the invention, according to which, briefly stated, at least one knife blade with the associated suction chamber is arranged between the licker-in and the frontal end roller of the travelling flats at a location adjacent the licker-in or in the frontal end roller. The mid-zone between the frontal end roller of the travelling flats and the licker-in may be occupied by stationary flats.

By virtue of the invention the degree of separation of impurities such as trash, shell fragments and the like is improved while the escape of useful fiber is eliminated or at least significantly reduced. It is of particular advantage that a great quantity of foreign bodies can be separated while the gap between the knife blade and the cooperating plate is maintained small. Thus, if, according to the invention, there is provided at least one knife blade externally of the mid-zone between the licker-in and the frontal end roller of the travelling flats and there is provided a relatively narrow gap between the knife blade and the plate, the exiting air stream has a great proportion of impurities and a very small or no proportion of useful fibers. It is a further advantage of the invention that at the locations where the separating device is provided, large impurities which have not yet been reduced by the flats of the card may be separated out. It is of importance that shell fragments with adhering fiber parts are separated before the fiber material reaches the flats of the card because these impurities are, by virtue of the flats and the cylinder clothing further comminuted and then may be removed only with difficulty. Prior to introduction into the zone of the flats, such fiber-carrying shell fragment portions are still unreduced and relatively large so that they may be advantageously sheared off by the knife blade and removed.

According to the invention, a knife blade with associated suction chamber may be provided solely between the stationary flats and the frontal end roller of the travelling flats or a single knife blade with associated suction chamber may be provided soley between the stationary flats and the licker-in or, such knife blades can be simultaneously used in both locations.

Preferably, the knife blade and the associated suction chamber are situated immediately upstream of the frontal roller of the travelling flats, as viewed in the direction of rotation of the carding cylinder. At this location, the air stream exiting through the gap is smaller than it would be in the mid-zone between the licker-in and the frontal end roller of the travelling flats so that, as a result, a lesser amount of useful fibers is removed. Also, before treatment by the knife blade, the fiber material is stripped flat by the stationary flats. Preferably, the suction hood defining the suction chamber has a further slot-like clearance which is oriented in the direction of the frontal end roller of the travelling flats. In this manner, in addition to the impurities separated by the knife blades, the suction hood, in addition to waste taken from the main cylinder, may also take impurities separated by the bars of the flats and remove the same by suction.

Expediently, the knife blade has a guide face which extends in the zone between the frontal end roller of the travelling flats and the additional gap. By virtue of this arrangement, the waste separated by the bars of the flats is directed into the waste chamber.

Preferably, the knife blade and the suction chamber are arranged immediately above the licker-in. This zone is characterized by particularly strong air turbulences whereby dust and particularly coarse waste is separated (hurled out) earlier and may be removed. The centrifugal force has a markedly smaller effect on the fibers. Particularly in case of a high rpm of the main cylinder, the air turbulences are greater so that even in case of a narrow gap at that location advantageously a high proportion of impurities may be separated without a significant proportion of useful fibers. According to a further advantageous feature of the invention, the knife blades with the suction chambers are situated immediately above the licker-in and immediately adjacent the frontal end roller of the travelling flats.

DESCRIPTION OF THE PREFERRED EMBODIMENTS

Figure 1:
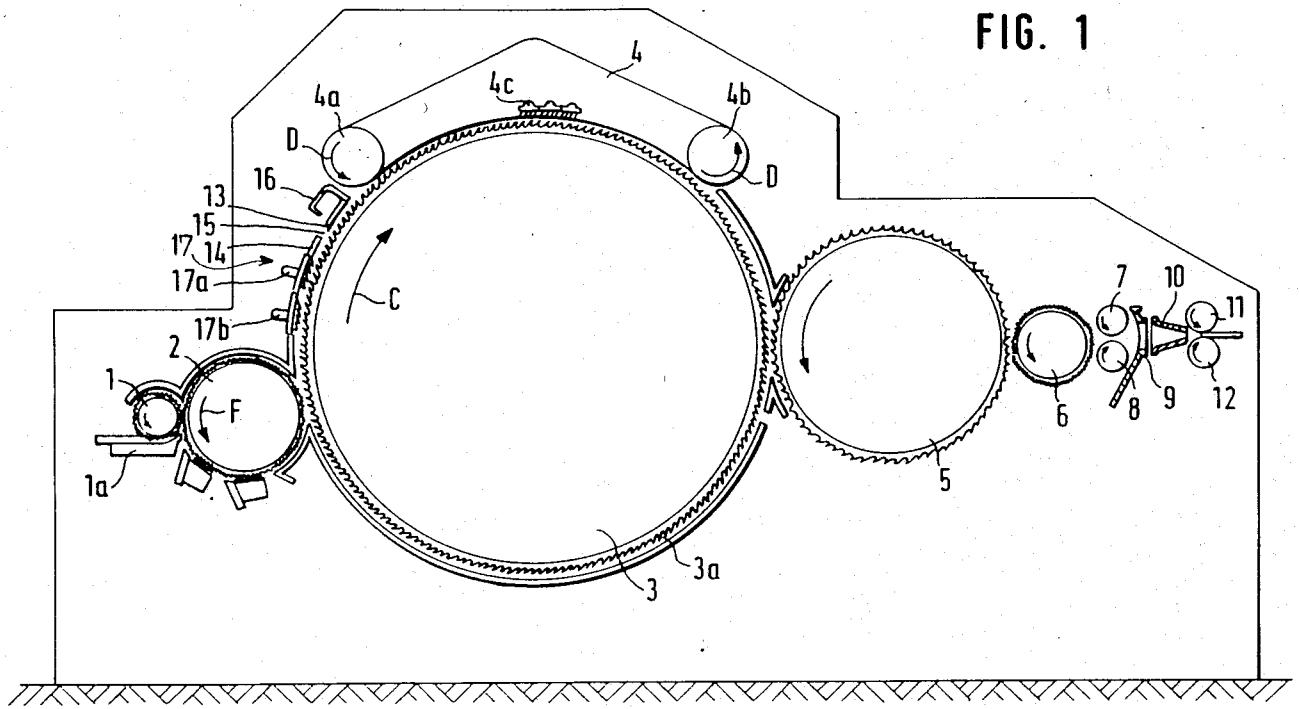
FIG. 1 is a schematic side elevational view of a carding machine incorporating a preferred embodiment of the invention.

Turning to FIG. 1, there is schematically illustrated a carding machine which in its conventional aspects may be an "EXACTACARD DK 715" model, manufactured by Trutzschler GmbH & Co. KG, Monchengladbach, Federal Republic of Germany. The carding machine has a feed roller 1, a feed table 1*a*, a licker-in 2 (rotated in the direction of arrow F), a main carding cylinder 3, travelling flats 4, a doffer 5, a stripper roller 6, crushing rollers 7 and 8, a web guiding device 9, a sliver trumpet 10 and calender rollers 11, 12. The direction of rotation (arrow D) of the frontal and rear end rollers 4*a* and 4*b* of the travelling flats 4 is opposite to the direction of rotation of the carding cylinder 3, as indicated by the arrow C.

As viewed n the direction of rotation C of the main cylinder 3, immediately upstream of the end roller 4*a* of the travellng flats 4 there is situated a knife blade 13 which is at a small distance from the cylinder 3 and is oriented opposite the direction of its rotation C and a plate 14 which is at a circumferential distance from the knife blade 13 upstream thereof. A gap 15 which is provided between the plate 14 and the knife blade 13 is in the working range of a suction chamber 16. With the clothing 3*a* of the carding cylinder 3 there cooperates the clothing of two stationary flats 17*a*, 17*b* which form a stationary flats assembly 17, situated generally at mid-distance between the licker-in 2 and the frontal end roller 4*a* of the travelling flats 4. The trash separating device formed of the knife blade 13, the plate 14 and the suction chamber 16 is thus situated between the frontal end roller 4*a* of the travelling flats 4 and the stationary flats 17. The cutting edge of the knife blade 13 is oriented opposite to the direction of rotation C of the carding cylinder 3.

Figure 2:
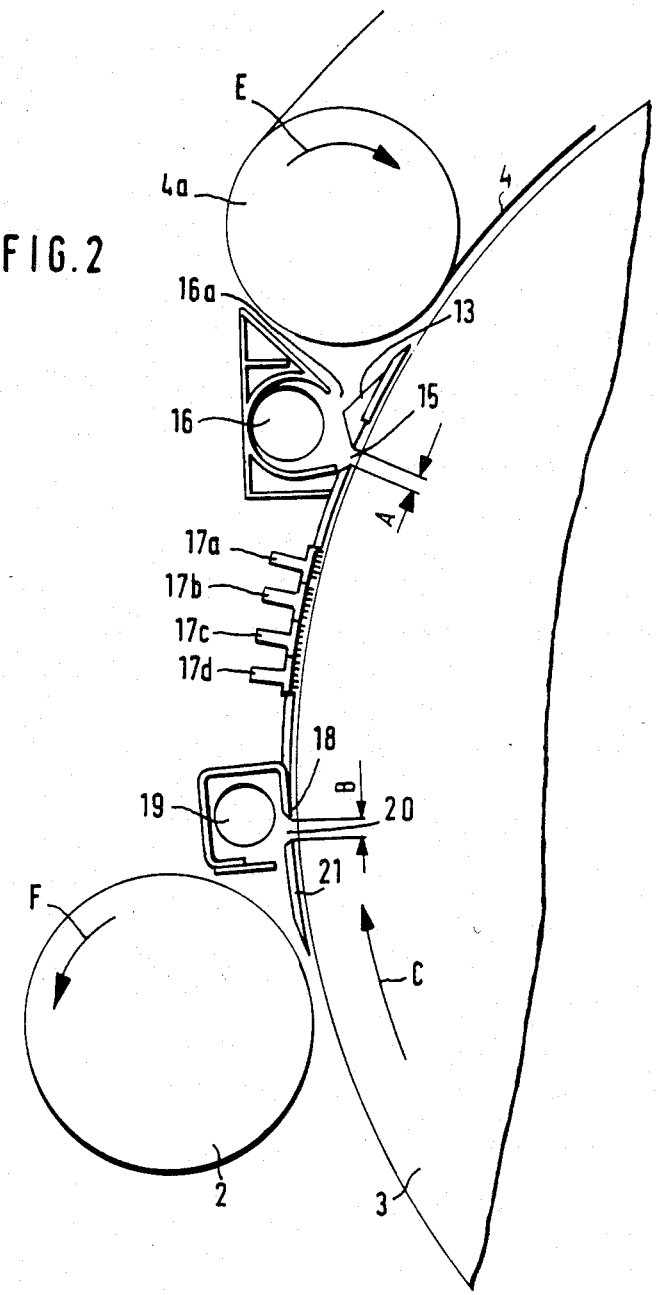
FIG. 2 is a schematic side elevational view of a further preferred embodiment of the invention shown at an enlarged scale relative to FIG. 1.

Turning to FIG. 2, the knife blade 13 with the suction chamber 6 is, similarly to FIG. 1, arranged immediately adjacent, that is, below the frontal end roller 4*a* of the travelling flats 4. The suction chamber 16 has a further slot-shaped opening 16a which is oriented towards the frontal end roller 4*a*. By virtue of this arrangement impurities which fall off the bars 4*c* (FIG. 1) of the travelling flats 4 are removed by suction through the opening 16 and impurities which are separated from the fiber material on the cylinder 3 may enter through the gap 15 (whose dimension may be, for example, 5 mm) into the suction chamber 16 and may be removed therefrom by suction.

Approximately in the mid-zone between the frontal end roller 4*a* of the travelling flats and the licker-in 2 there is arranged a stationary flats assembly formed of four stationary flats 17*a*, 17*b*, 17*c* and 17*d*. Between the stationary flats 17*d* and the licker-in 2 there is arranged a further knife blade 18 with an associated suction chamber 19. The gap 20 which also may have a dimension of approximately 5 mm and which is located between the knife blade 18 and the plate 21 is covered by the suction chamber 19. The cutting edges of the knife blades 13 and 18 are oriented opposite to the direction of rotation C of the carding cylinder 3.

Figure 3:
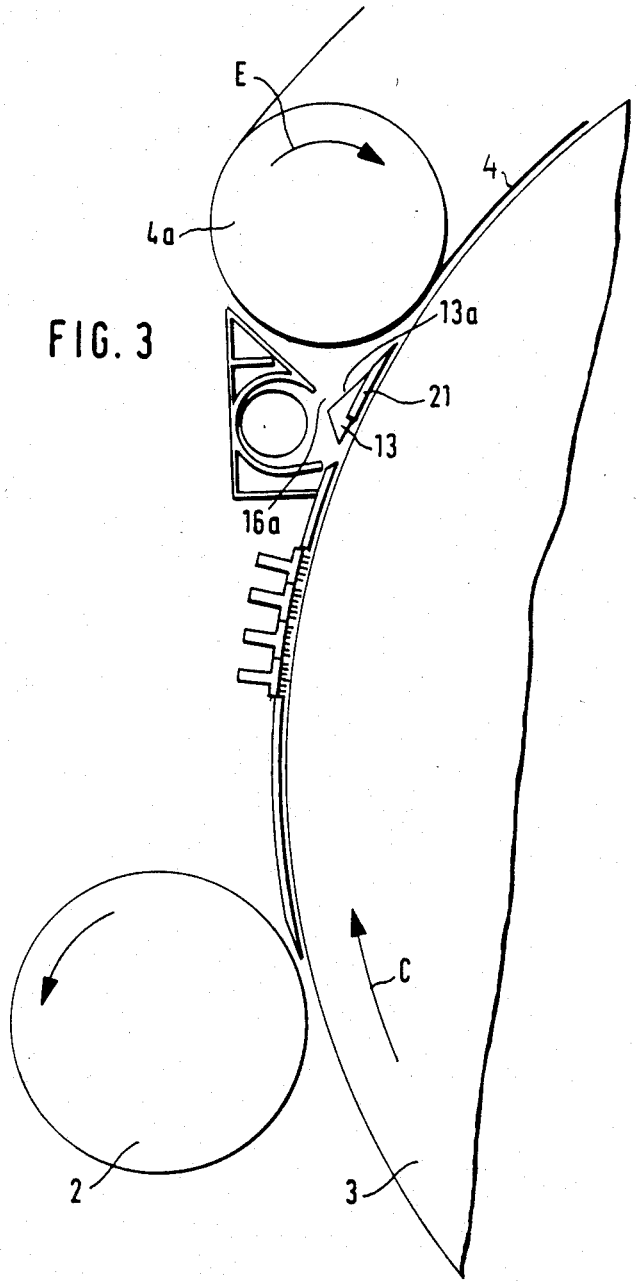
FIG. 3 is a schematic side elevational view of still another preferred embodiment of the invention.

Turning now to FIG. 3, the knife blade 13 has a guide face 13*a* on its back which extends in the zone of the frontal end roller 4*a* of the travelling flats 4 and the additional clearance 16*a*. In this manner, the impurities falling off the bars of the travelling flats 4 are directed through the gap 16*a* into the suction chamber 16. The cutting edge of the knife blade 13 is oriented in a direction opposite to the direction of rotation C of the carding cylinder 3.

Figure 4:
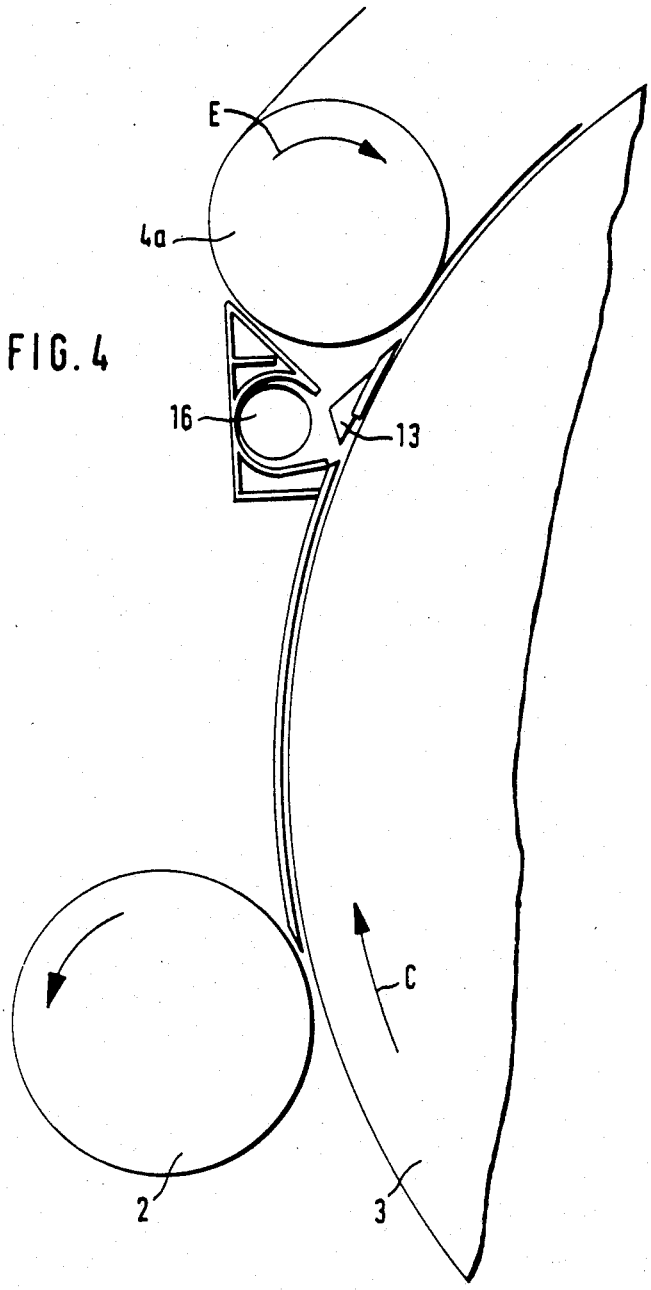
FIG. 4 is a schematic side elevational view of still a further preferred embodiment of the invention.
Figure 5:
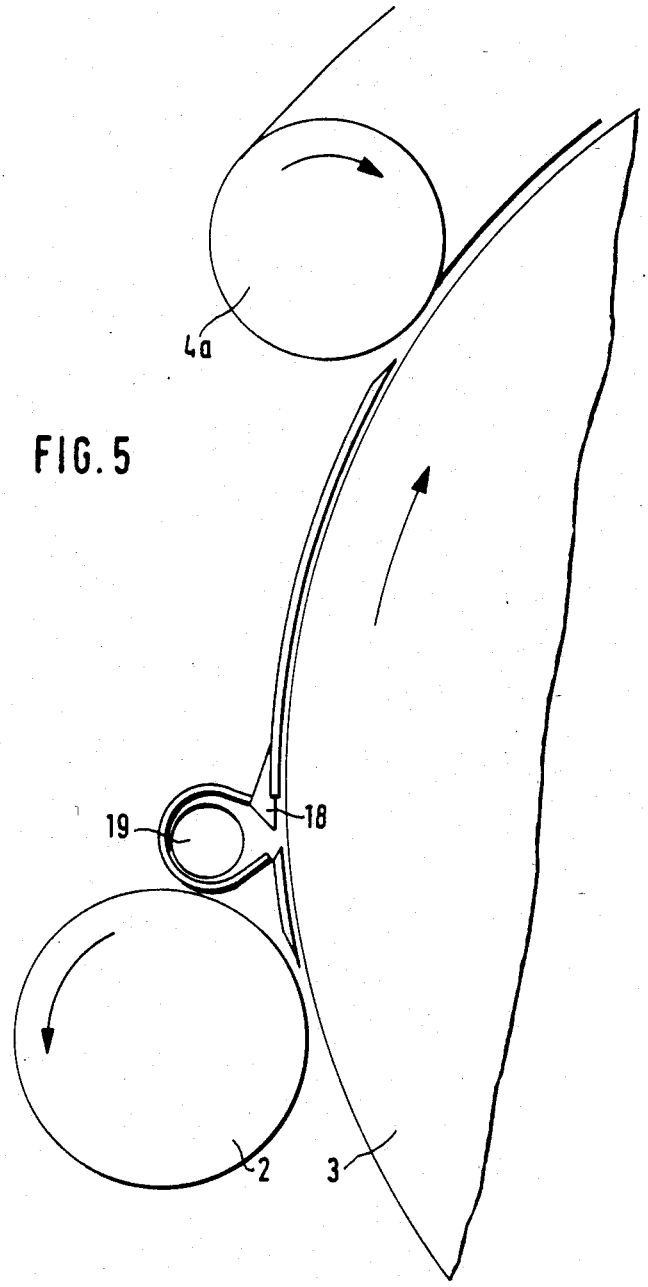
FIG. 5 is a schematic side elevational view of yet another preferred embodiment of the invention.

Turning to FIGS. 4 and 5, in the embodiments shown therein no stationary flats are present between the frontal end roller 4*a* of the travelling flats 4 and the licker-in 2. According to FIG. 4, the knife blade 13 with the suction device 16 is situated immediately adjacent, that is, immediately underneath the end roller 4*a* of the travelling flats 4. According to FIG. 5, the knife blade 18, together with the associated suction device 19 is situated immediately above the licker-in 2.

In the embodiments illustrated in FIG. 2–5, the direction of rotation of the frontal end roller 4*a* (as indicated by the arrow E) and that of the rear end roller 4*b* (not shown in FIGS. 2–5) are codirectional with the direction of rotation (arrow C) of the carding cylinder 3, as opposed to the arrangement according to FIG. 1.

It will be understood that the above description of the present invention is susceptible to various modifications, changes and adaptations, and the same are intended to be comprehended within the meaning and range of equivalents of the appended claims.

What is claimed is:

1. A carding machine comprising in combination:

(a) a main cylinder having a direction of rotation;

(b) a licker-in cooperating with the main cylinder;

(c) travelling flats cooperating with the main cylinder;

(d) a frontal end roller supporting said travelling flats; said end roller being situated above said licker-in at a distance therefrom as viewed circumferentially along said main cylinder; said distance having a mid-zone and two off-center zones flanking the mid-zone and adjoining the licker-in and the end roller, respectively;

(e) stationary flats supported in said mid-zone and being at a small radial distance from the main cylinder; and (f) a device for separating impurities from fiber material undergoing treatment by said main cylinder; said device being situated in one of said off-center zones, between said frontal end roller and said stationary flats; said device having (1) a knife blade supported at a small radial distance from the main cylinder and including a knife edge oriented opposite to said direction of rotation;

(2) a plate supported at a small radial distance from the main cylinder and defining a gap with said knife edge; and (3) means defining a suction chamber covering said gap.

2. A carding machine as defined in claim 1, wherein said device immediately adjoins said end roller.

3. A carding machine as defined in claim 2, wherein said means defining said suction chamber comprises a suction hood having a gap-like opening oriented towards said end roller.

4. A carding machine as defined in claim 3, wherein said knife blade has a back portion provided with a guide face extending from said gap-like opening towards said end roller.

5. A carding machine as defined in claim 1, wherein said device is a first device, further comprising a second device for separating impurities from fiber material undergoing treatment by said main cylinder; said second device being structured substantially identically to said first device and being situated between said licker-in and said stationary flats.

* * * * *